United States Patent [19]

van Maanen

[11] 4,422,591

[45] Dec. 27, 1983

[54] SHAFT HAVING MEANS FOR RETAINING THEREON A REEL, MATERIAL ROLL OR SIMILAR ARTICLE

[75] Inventor: Johannes D. van Maanen, Berkel en Rodenrijs, Netherlands

[73] Assignee: Teuopharm-Schiedam B.V., Schiedam, Netherlands

[21] Appl. No.: 328,515

[22] Filed: Dec. 8, 1981

[30] Foreign Application Priority Data

Jun. 11, 1981 [NL] Netherlands ..... 8102815

[51] Int. Cl.[3] ..... B65H 75/24

[52] U.S. Cl. ..... 242/72.1

[58] Field of Search ..... 242/68.2, 72, 72.1, 242/72 B, 46.4

[56] References Cited

U.S. PATENT DOCUMENTS

| | | | |
|---|---|---|---|
| 2,556,149 | 5/1951 | Talbot | 242/72.1 X |
| 2,733,874 | 2/1956 | Petersen et al. | 242/72 |
| 3,722,808 | 3/1973 | Brown | 242/72.1 X |
| 4,147,312 | 4/1979 | Secor | 242/72 R |

FOREIGN PATENT DOCUMENTS

| | | |
|---|---|---|
| 10266 | 4/1980 | European Pat. Off. . |
| 620611 | 6/1937 | Fed. Rep. of Germany . |
| 2106057 | 4/1972 | France . |
| 7503123 | 9/1975 | Netherlands . |

*Primary Examiner*—John M. Jillions
*Assistant Examiner*—Lloyd D. Doigan

[57] ABSTRACT

A number of elongated pressure members are located in recesses in the shaft, to be displaced axially and radially outwards by means of pressurized fluid until they engage against the inside of the reel. Within the pressure members an actuating sleeve is mounted for reciprocating movement between extreme end positions, and having wedge surfaces cooperating with wedge surfaces formed on the pressure members. Two spaces are defined in the shaft communicating with each other through a relatively narrow channel and closed by a first valve member in one position. The first space communicates directly with the source of pressurized fluid. The second space is bounded by a surface of the actuating sleeve and is provided with a second normally closed valve member. The first valve member is so coupled to the pressure members that when they are moved to one end position the first valve member is opened, so that the pressurized fluid is permitted to flow into the second space through the channel and the actuating sleeve is urged to the other end position. By opening the second valve member the fluid pressure in the second space is relieved and the actuating sleeve is urged to the one end position again.

12 Claims, 4 Drawing Figures

Figure 1:
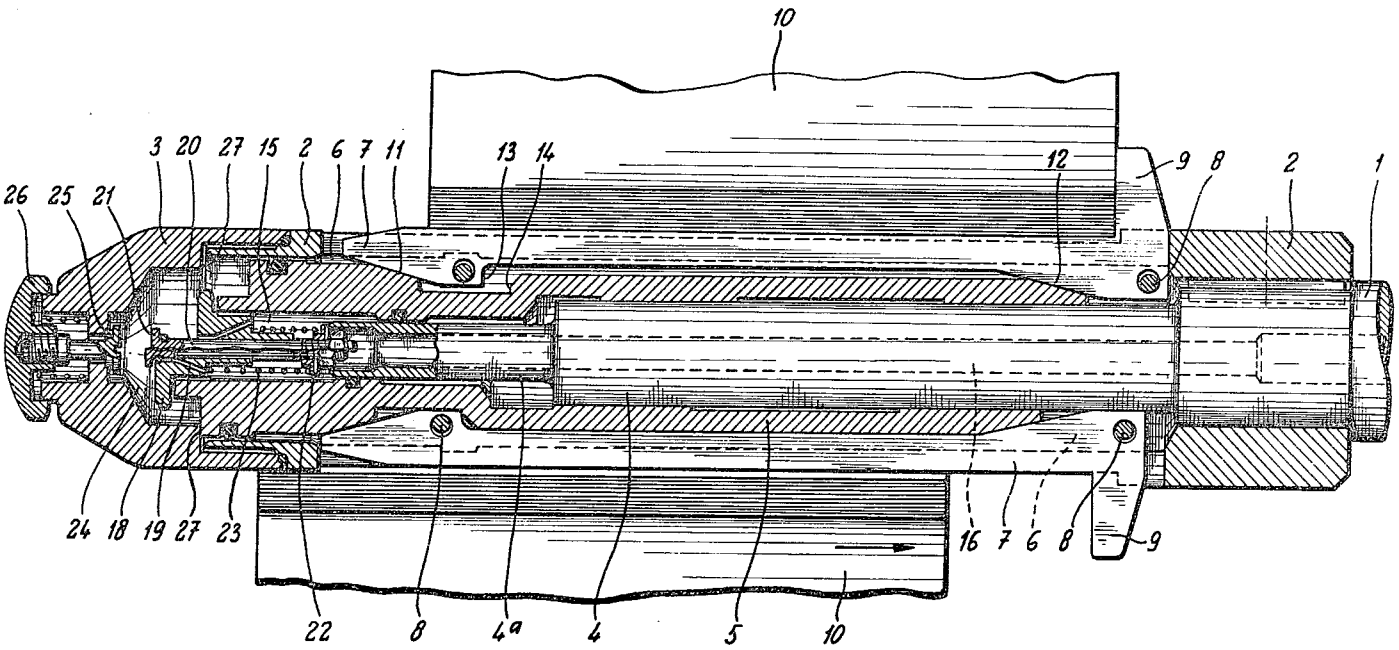

SHAFT HAVING MEANS FOR RETAINING THEREON A REEL, MATERIAL ROLL OR SIMILAR ARTICLE

The invention relates to an apparatus comprising a protruding shaft having means for retaining thereon a reel, material roll or similar article which is slipped on the shaft from its free end, which means comprise a number of elongated pressure members located in recesses in the shaft, which by means of a pressurized fluid supplied through the shaft through a connection to be coupled with a source of pressurized fluid, can be displaced radially outwards until they engage the inside of the central cavity of a reel slipped on the shaft and which can move radially inwards again for removing the reel from the shaft. This apparatus serves in particular for being applied in a packing machine in which articles are packed continuously in a packing material web unwound from a packing material roll retained on the shaft. Such an apparatus is known from the European Patent Publication No. 10266, April 1980.

In the known apparatus under each pressure member an elongated bag of flexible material is provided, of which the inside communicates with the connection to a source of a pressurized fluid and in which a no-return valve is positioned so that for the radial outwards displacement of the pressure members each bag associated with a pressure members has to be inflated by connecting the source of pressurized fluid to the connector during a predetermined time and for a radial inwards displacement of the pressure members the no-return valve has to be depressed in order to deflate the bags again. Moreover, the position of a reel retained on the shaft can vary within broad limits.

These are severe disadvantages of said apparatus, in particular in using it in a packing machine of the above mentioned type as in current high speed packing machines a finished packing material roll should also be rapidly exchangeable by a new roll, in particular in packing machines in which the end of the unwound material web is automatically spliced to the leading end of a second stand-by roll of packing material in the machine, and the depression of the no-return valve for shifting the finished roll from the shaft the coupling of the source of pressurized fluid after a new roll is slipped on the shaft consumes much time apart from the fact that said coupling may be forgotten easily by the operator, while by leakage the fluid pressure may decrease such that the roll is disengaged from the shaft. Besides, it is of greatest importance that the roll slipped and locked on the shaft is positioned accurately in a predetermined position as otherwise the packing machine cannot operate correctly.

The object of the invention is to provide an apparatus of the above mentioned type which does not have said disadvantages.

Said object is achieved in that in the apparatus according to the invention each pressure member is mounted also for a slideable movement in axial direction between a front and a rear position in the associated recess and is provided with a radially outwards protruding stop at the end remote from the free end of the shaft so that by means of a reel slipped on the shaft and in engagement with the stops, the pressure members can be shifted into the hind most position. Within the pressure members actuating means are mounted for an axially reciprocating movement, which at its outer side is provided with at least one wedge surface cooperating with wedge surfaces formed at the inner side of the pressing means so that by a movement of the actuating means from the one outmost position to the other the pressure members are urged radially outwards to their hind most position. Also, means are provided for returning the pressure members to the foremost position by a movement of the actuating means to the one outmost position, the actuating means having a stop surface bearing against a stop surface formed in the shaft in said one outmost position of the actuating means. Means acting as a spring are provided for urging the actuating means to said one outmost position, and further two spaces in the shaft are defined communicating with each other through a relatively narrow channel, a first valve member being provided closing this channel in the one outmost position of the actuating means and the first space is in direct communication with the connection to a source of pressurized fluid so that in the operative condition said space is filled with the pressurized fluid. The second space is bounded by a substantially transversely extending surface of the actuating means and is provided with a second normally closed valve member, while the first valve member is connected to the pressing means such that in sliding said means to their hind most position, the first valve member is opened. Thus, the pressurized fluid is permitted to flow through said channel into the second space so that the actuating means is driven to the other outmost position by the fluid pressure acting on said transverse surface for the radial displacement of the pressure members by means of the wedge surfaces, and by opening the second valve member the fluid pressure in the second space is relieved so that the actuating means is urged to the one outmost position again by said means acting as a spring.

In an apparatus constructed in this way a reel can be retained quickly in the correct position on the shaft by simply slipping the reel while in engagement with the stops to an end position on the shaft, which end position is defined by the hind most rear position of the pressure members, said members being automatically displaced radially outwards for locking the reel. Moreover, the connection to the source of the pressurized fluid is maintained, by which any leakage is compensated for and the fluid pressure remains sufficiently high for retaining the reel on the shaft.

Preferably the means acting as a spring are formed by the fluid pressure in the first space, said space being bounded by a transverse surface of the actuating means which has a smaller area than the transverse surface of the actuating means bounding the second space and which faces in opposite direction.

Advantageously, at least the front portion of the shaft is hollow and the actuating means is formed by a sleeve disposed within this cavity and mounted for an axially slidable movement around a coaxial stub axle protruding into the cavity and connected to the shaft, said first space being enclosed by the front portion of the sleeve extending beyond the stub axle, which portion is substantially closed at the front side and communicates at the rear side with the connection for the coupling with a source of a pressurized fluid through a channel extending through the stub axle, while said second space is formed by the front portion of the cavity of the shaft between the closed front end of the sleeve and the closed front end of the hollow shaft.

The channel connecting the first and second space to each other may extend through the front closure of the first space, and the first valve member may be formed by a valve element engaging the front side of said front closure in the one outmost position of the actuating means so that thereby the outlet of the channel into the second space is closed and said element in the other outmost position of the actuating means is spaced apart therefrom.

Preferably the valve element is provided on the front end of a rod extending through an aperture in the front closure so that said closure is permitted to slide along the rod, in a spring seat being fixed on the rod near its rear end for supporting a spring at its one side, which at its other side engages the front closure, while the spring seat in a movement of the actuating means to the other outmost position engages the front end of the stub axle, and the actuating means has a stop surface engageable by the stops formed on the pressure members, such that in a sliding movement of the pressure members to the hind most position the actuating means is carried along and in a movement of the actuating means to the one outmost position the pressure members are shifted in the foremost position again.

The pressure members may be retained in the recesses in the shaft by means of tension springs extending through apertures in said shaft.

As already mentioned above in the apparatus according to the invention it is assured that a material roll of a certain width is locked on the shaft in a correct position with respect to the packing machine. However, it is frequently desired in a packing machine, that packing materials of different widths can be used, which means that preferably the position of a material roll on the shaft with respect to the packing machine should be variable. According to the invention this is achieved in that the shaft is supported for an axially sliding movement and means are provided for reciprocating the shaft.

In this way, by an axially sliding movement of the shaft the position in which a material roll is locked on the shaft, which position is defined by the hind most position of the pressure members can be varied transversely with respect to the packing machine so that packing material rolls of different widths can be used in one and the same packing machine. In manufacturing a packing material roll during spooling the material into a roll, or by drying of the packing material, differences in strain may occur between the side edges of the material web, by which in unwinding, the material web is curved slightly which can lead to detracking of the material web in the packing machine. Therefore, it is desired in the operation of the packing machine to be able to regulate the material web extending from the packing material roll to the packing machine in the transverse direction in order to prevent detracking of the material web.

Advantageously, therefore the slidability of the shaft according to the invention is utilized, the means for shifting the shaft comprising a motor controlled by signal means which in the event of a deviating transverse position of at least one side edge of the packing material web produces a signal for actuating the motor, by which the shaft is displaced in a predetermined direction to correct the position of the side edge.

Preferably a timing device is provided which after the actuation of the motor by said signal stops again the motor after a displacement of the shaft over a predetermined distance is obtained, and a controlling device by which after stopping the motor and after a predetermined length of the material web having passed said device, a signal from the signal means is passed again to the motor.

In this way it is achieved that the shaft is axially shifted stepwise and always after such a step it is determined by the signal means whether by shifting the shaft the deviating position of the packing material web sensed by said means is corrected sufficiently. Thus it is prevented that the shaft is shifted too far for correcting the position of the material web, so that the shaft should be shifted in opposite direction again resulting in the material web being not in the correct position during a relatively long time.

Advantageously the signal means are formed by two photocells spaced apart transversely of the material web and arranged near an edge of the material web such that in a correct position of said edge the one photocell is facing the material web at a relative short distance from said edge and that the other photocell is at a relatively short distance from the edge outside of the material web.

In this way, in a correct position of the material web only said one photocell delivers a signal and in a faulty position of the material either both of the photocells deliver a signal or both of the photocells do not deliver a signal.

The controlling device is preferably formed by a photocell disposed at a predetermined position between the signal means and the shaft and adapted to deliver a signal when a mark provided on the packing material web passes said photocell and by a counting device capable of counting a predetermined number of said signals.

In a packing machine it can happen that for example by dirt entering the guides of the articles to be packed the packing material web deviates so much from the correct position that for correcting said deviating position the shaft should be shifted in one direction over a large distance which is undesirable.

Therefore, preferably a protruding plate is connected to the shaft journalled for a sliding movement, which plate has a predetermined width parallel to the axis of the shaft, while a substantially fixedly arranged inductive sensor is provided which is directed approximately to the center of said plate, and capable of delivering a signal when an edge of the plate, passes said sensor by which the packing machine is stopped.

It is noted that from the European Patent Application No. 80301268.1 a guiding system for a material web is known, in which said web is passed over two rollers mounted for a movement so that their axes are tilted, while said rollers are controlled by signal means sensing the edges of the material web by means of infrared radiation.

Figure 2:
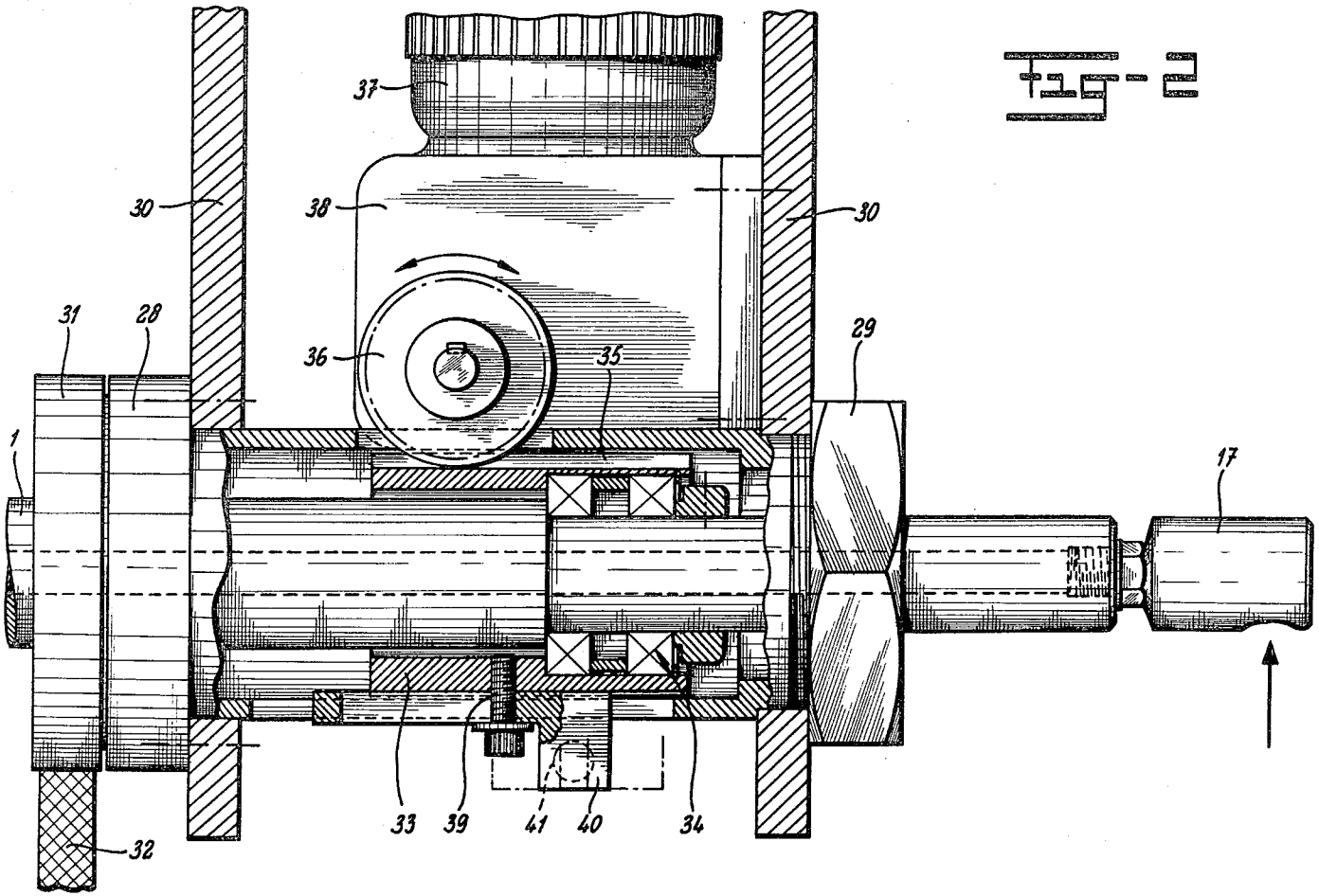
Figure 3:
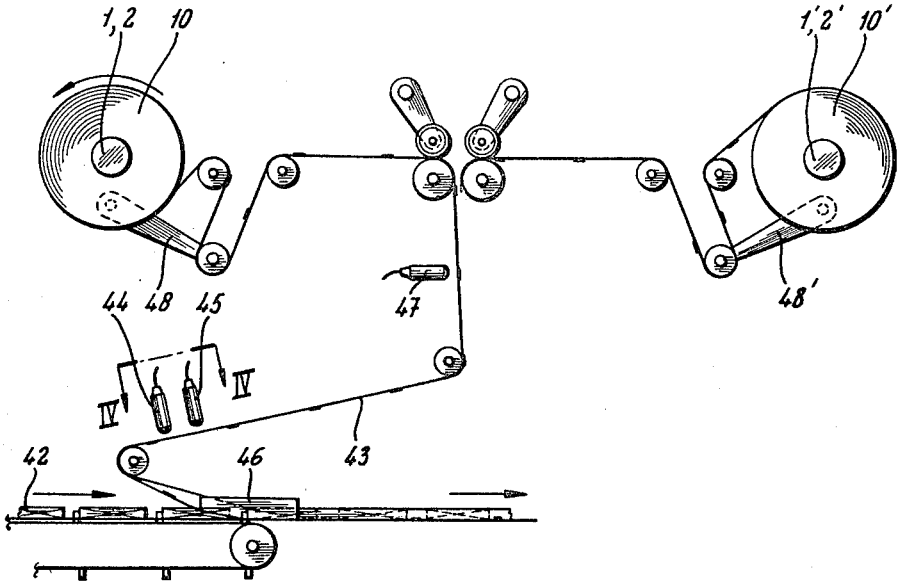
Figure 4:
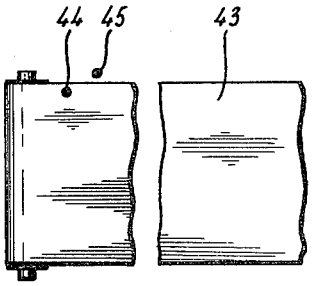

The invention will be explained in detail with reference to the drawings, in which:

FIG. 1 shows in longitudinal section the front portion of an apparatus according to the invention, FIG. 2 shows the rear portion of the apparatus according to FIG. 1, FIG. 3 schematically illustrates a packing machine in which an apparatus according to FIGS. 1 and 2 is used, and FIG. 4 is a view according to the line IV—IV in FIG. 3.

As shown in FIG. 1 the apparatus according to the invention comprises a shaft 1 and a hollow shaft 2 surrounding it and closed by the nose piece 3 at the front side. The shaft 1 comprises a stub axle 4 located within the hollow shaft 2 and having a front portion 4a along which the sleeve-shaped actuating means 5 is permitted to slide in axial direction. In the hollow shaft 2 a number of recesses 6 is provided in which the pressure members 7 are positioned which are retained in the recesses 6 by tension springs 8 extending through apertures in the pressure members 7. From the figure appears that the recesses 6 have a slightly larger length than the pressure members 7 so that the latter are permitted to slide in axial direction between a foremost position shown in the lower part of the figure and a hindmost position shown in the upper part of the figure. Each pressure member 7 has a stop 9 extending radially outwards against which the reel or material roll 10 slipped on the shaft can bear.

Further the pressure members 7 are provided with two sets of wedge surfaces 11 and 12 cooperating with wedge surfaces formed at the external side of the actuating means 5 so that in sliding of the actuating means 5 from the one outmost position indicated in the lower part of the figure to the other outmost position indicated in the upper part of the figure, the pressure members 7 are displaced radially outwards.

Moreover the pressure members 7 are provided with stop surfaces 13 cooperating with the stop surfaces 14 respectively of the actuating means 5. The front portion of the actuating means 5 extends beyond the end of the stub axle portion 4a so that a space 15 is defined communicating with the connection 17 with a source of pressurized fluid shown in FIG. 2, by means of the channel 16 extending through the shaft 1 and the stub axle 4, 4a.

The space 15 is closed at the front end by the front closure 18 through which a relatively narrow channel 19 extends. Through the front closure 18 a slideable stem 20 extends carrying at its front end the valve element 21 and at its rear end a spring seat 22, retained by a screwed on nut. Between said spring seat 22 and front closure 18 a spring 23 is located. In the nose piece 3 a second space 24 is defined and in the nose piece a valve 25 is provided adapted to be forced open by means of the press-button 26. Further in the nose piece 3 a stop surface 27 is formed against which the front end of the actuating means 5 bears in said one outmost position of said actuating means.

In the lower half of FIG. 1 the situation is shown, in which no reel 10 is provided on the shaft or in which the reel 10 is slipped on the shaft but is not yet in engagement with the stops 9. In the space 15 a constant pressure of the pressurized fluid supplied by the channel 16 is operative so that as a result of the fluid pressure exerted on the rear end of the front closure 18, the actuating means 5 is pushed against the stop member 27. Thereby, the valve element 21 is pushed against the front side of the front closure 18 by the spring 23 so that the end of the channel 19 opening into the second space 24 is closed.

Now, when the reel 10 is slipped further on the shaft said reel engages the stops 9 so that in pushing the reel 10 still further on the shaft the pressure members 7 are shifted to the hindmost position shown in the upper part of the figure. By means of the stop surfaces 13, 14 the actuating means 5 is carried along, so that the front closure 18 is shifted rearwards along the stem 20 and the spring seat 22 abuts the front end of the front portion 4a of the stub axle and the channel 19 is released from the valve element 21. The pressurized fluid in the space 15 is now permitted to flow through the channel 19 into the second space 24, whereupon a pressure is exerted on the front side of the front closure 18 and the actuating means 5 is shifted further to the right into the other utmost position indicated in the upper part of the figure so that by means of the wedge surfaces 11, 12 the pressure members 7 are displaced radially outwards and engage the inner side of the center space in the reel 10. In this way reel 10 is locked and indeed is in a predetermined position defined by the hindmost position of said pressure members 7.

For shifting a reel 10 from the shaft the press-button 26 is depressed, by which the pressure in the space 24 is released so that no pressure is exerted on the front end of the front closure 18 and the actuating mean 5 is urged to the left into the one outmost position by the fluid pressure in the space 15, and the channel 19 is closed by the valve element 21. Thereby, and pressure members 7 are first moved radially inwards by the tension springs 8 and thereafter shifted again into their foremost position because the stop surface 14 engages the surface 13.

As shown in FIG. 2 the shaft 1 is supported for a free rotation and sliding movement in the bearings 28 and 29 mounted in the frame 30. With 31 a brake drum provided on the shaft 1 is indicated and with 32 a brake shoe. A sleeve 33 is mounted on the shaft 1, through the ball bearing 34. Sleeve 33 is provided with teeth 35 in meshing engagement with the teeth of the gear 36. The gear 36 can be driven in rotation in both directions by means of the motor 37 and a reduction mechanism in the box 38.

To the sleeve 33, by means of the screw 39 a plate-shaped member 40 is fixed which faces an inductive sensor 41.

As shown in FIG. 3 a packing machine comprises two shafts 2, 2' shown in FIGS. 1 and 2 on which the material web rolls 10 and 10' are retained. In packing the articles 42 a material web 43 is unwound from the on roll 10, whereas the packing material roll 10' is in the stand-by condition so that by means not shown the trailing end of the material web 43 unwound from the roll 10 is automatically spliced to the leading end of the material web 10' so that the packing machine can operate continuously when the material roll 10 is depleted. Then, the finished roll 10 can be exchanged by slipping a new roll on the shaft 2, so that said roll will be in the correct position automatically. This position substantially defined by the hindmost position of the pressure members 7 is preadjusted by shifting the shaft 1. If after packing a number of articles 42, other articles have to be packed in the packing machine, in which a packing material of a different width has to be used, then the shafts 2 and 2' are shifted into the correct position so that each packing material roll locked on said shafts are in the correct position again with respect to the packing machine.

As shown in the FIGS. 3 and 4 there are two photocells 44 and 45 arranged above the material web near one of their side edges. The photocell 44 is directed at said web at a short distance from the side edge of the material web and the photocell 45 is directed at a point located outside the material web 44 at a short distance from said edge so that in the correct position of said edge shown in FIG. 4, only by the photocell 44 a signal is excited, in which correct position the material web 43 is guided correctly in the folding box 46 of the packing machine so that also the articles 42 are packed correctly. However, if for some reason the edge of the material web 43 is shifted to a lower position with respect to the position shown in FIG. 4 so that also the photocell 4 is directed at a point outside said material web, then a signal is delivered to the motor 37 by which the motor is activated during a short time through a time relay not shown so that the shaft 1 is shifted through the gear 36 over a predetermined distance in the direction opposite to the direction in which the edge of the material web has been displaced. From said moment, by means of a pulse counter (not shown) a predetermined number of pulses is counted, said pulses being produced in that marks on the material web 43 pass the photocell 47. This number is defined such that the number of counted pulses at least equals the number of marks on the portion of the material web 43 between the photocells 44, 45 and the shaft 1, so that when said number is reached the effect of the displacement of the shaft 1 has reached the photocells 44 and 45. If by the displacement of the shaft 1, the edge of the material web has not come in the correct position yet, then by the signal from the photocells 44, 45 the motor 37 is activated again during a certain time. Said steps are repeated if necessary until the edge of the material web is in the correct position.

The above mentioned steps are also carried out when the edge of the material web 43 is shifted to a higher position with respect to the position shown in FIG. 4 so that also by the photocell 45 a signal is delivered.

In the event of an extensive deviation from the correct position of the edge of the material web, for example as result of dirt entering the folding mechanism in the folding box 46, the shaft 1 is shifted in one direction over such a great distance that the inductive sensor 41 is directed at a point outside one of the side edges of the plate-shaped member 40, by which the packing machine is switched off.

In FIG. 3 the compensation arms 48 and 48' are still shown each connected to the brake shoe 32 associated with the respective shaft 1.

I claim:

1. Apparatus for detachably connecting a hollow reel, material roll or similar article on a shaft and to be slipped on the shaft from a free end thereof, said shaft having recesses, said apparatus comprising: a plurality of elongated pressure members located in said recesses and adapted to be displaced radially outwards by means of a pressurized fluid supplied through the shaft from a source of pressurized fluid until said pressure members engage the inside of the reel and also adapted to move radially inwards again for removing the reel from the shaft, each pressure member being mounted in its associated recess also for a slidable movement in axial direction between a first and a second position, and provided at the end remote from the free end of the shaft with a stop projecting radially outwards for shifting the pressure members into the second position by means of the reel slipped on the shaft and engaging the stops, actuating means mounted within the pressure members for axially reciprocating movement between a third and a fourth position, said actuating means being provided with wedge surface means cooperating with wedge surface means formed at said pressure members so that by a movement of the actuating means from said third position to said fourth position the pressure members are urged radially outwards, and means for returning the pressure members radially inwards by a movement of said actuating means to said third position, said actuating means having a stop surface bearing against a stop surface formed at the shaft in said third position of said actuating means, means acting as a spring being provided urging said actuating means to said third position. two spaces being defined in the shaft and communicating with each other through a relatively narrow channel, a first valve member closing said channel in said third position of said actuating means and the first space communicating with the source of pressurized fluid so that in operation said first space is filled with said pressurized fluid, said second space being defined in part by a substantially transversely extending surface of said actuating means and being provided with a second, normally closed, valve member, said first valve member being coupled to said pressure member such that when said pressure members are moved to said second position the first valve member is opened, so that the pressurized fluid flows into said second space through said channel whereby said actuating means is urged to said fourth position by the fluid pressure acting on said transverse surface for displacing radially the pressure members by means of said wedge surface means by opening said second valve member the fluid pressure in the second space being relieved so that said actuating means is urged to said third position again by said means acting as a spring.

2. Apparatus according to claim 1, wherein said means acting as a spring is formed by fluid under pressure in said first space, said first space being defined in part by a transversely extending surface of said actuating means which has a smaller area than the transverse surface of the actuating means partly defining said second space and which faces in opposite direction.

3. Apparatus according to claim 2, wherein at least a portion of the shaft is hollow and wherein said actuating means is formed by a sleeve disposed within said shaft and mounted for an axially slidable movement around a stub axle connected to said shaft and extending coaxially in said shaft, said first space being enclosed by a part of the sleeve extending beyond said stub axle, said part being substantially closed at one end and at the other communicating with the source of pressurized fluid through a channel extending through the stub axle, said second space being formed by a hollow portion of the shaft between the closed end of the sleeve and a closed end of the hollow shaft.

4. Apparatus according to claim 3, wherein said channel connecting said first and second spaces with each other extends through a closure of the first space, and wherein said first valve member is formed by a valve element which in said third position of said actuating means engages said closure of said first space, whereby the outlet of the channel in said second space is closed and which in the said fourth position of said actuating means is spaced apart therefrom.

5. Apparatus according to claim 4, wherein said valve element is provided on one end of a rod extending through an aperture in said closure so that said closure is adapted to slide along the rod, a spring seat being fixed on the rod near its other end for supporting one end of a spring engaging with the other end said closure, said spring seat upon a movement of said actuating means to said fourth position engaging one end of said stub axle, said actuating means having a stop surface engageable by said stops formed on said pressure members, such that upon shifting said pressure members to said second position said actuating means is carried along, and upon a movement of said actuating means to said third position said pressure members are shifted to their first positions again.

6. Apparatus according to claim 1, wherein said pressure members are retained in the recesses in the shaft by tension springs extending through apertures in said actuating means.

7. Apparatus according to claim 1, wherein the shaft is supported for an axially sliding movement, and comprising means for reciprocating the shaft.

8. Apparatus according to claim 7, in a packaging machine, wherein said means for shifting the shaft comprise a motor controlled by signal means adapted to deliver a signal for activating the motor in the event of a deviating transverse position of at least one side edge of a packing material web unrolling from said reel, so that the shaft is displaced in a predetermined direction to correct the position of the side edge.

9. Apparatus according to claim 8, wherein a timing device is provided which, after the activation of the motor by said signal, stops again said motor after a displacement of the shaft over a predetermined distance is reached, and a controlling device by means of which, after stopping the motor and after a predetermined length of the material web has passed said device, a signal from said signal means can be transmitted again to the motor.

10. Apparatus according to claim 9, wherein said controlling device is formed by a photocell located in a predetermined position between the signal means and the shaft and adapted to deliver a signal when a mark provided on the packing material web passes said photocell, and a counting device capable of counting a predetermined number of said signals.

11. Apparatus according to claim 8 wherein said signal means are formed by two photocells spaced apart in a transverse direction with respect to the material web and arranged near an edge of the material web such that in a correct position of said edge one photocell is directed on the material web at a relatively short distance from said edge and the other is located outside the material web at a relatively short distance from said edge.

12. Apparatus according to claim 8, wherein a plate is connected to the shaft and journaled for a sliding movement, said plate having a width extending parallel to the axis of the shaft, and a substantially fixedly arranged inductive sensor directed approximately to the center of said plate, said sensor being capable of delivering a signal when an edge of the plate passes said sensor, to thereby stop said packaging machine.

* * * * *

UNITED STATES PATENT AND TRADEMARK OFFICE

CERTIFICATE OF CORRECTION

PATENT NO. : 4,422,591

DATED : December 27, 1983

INVENTOR(S) : Johannes D. van Maanen

It is certified that error appears in the above-identified patent and that said Letters Patent are hereby corrected as shown below:

On the title page assignee should read

-- [73] Assignee: Tevopharm - Schiedam B.V., Schiedam, Netherlands --

Signed and Sealed this

*Thirty-first* Day of *July 1984*

[SEAL]

*Attest:*

GERALD J. MOSSINGHOFF

*Attesting Officer*

*Commissioner of Patents and Trademarks*